US006948284B2

(12) United States Patent
Chiang

(10) Patent No.: US 6,948,284 B2
(45) Date of Patent: Sep. 27, 2005

(54) ALL-DIRECTIONAL DAMPING AND EARTHQUAKE-RESISTING UNIT

(76) Inventor: Te-Chuan Chiang, 22F-3, No. 188, Ching Hsing Rd., Taipei (TW)

( * ) Notice: Subject to any disclaimer, the term of this patent is extended or adjusted under 35 U.S.C. 154(b) by 92 days.

(21) Appl. No.: 10/430,252

(22) Filed: May 5, 2003

(65) Prior Publication Data

US 2004/0221520 A1 Nov. 11, 2004

(51) Int. Cl.[7] ..... E04B 1/98
(52) U.S. Cl. ..... 52/167.1
(58) Field of Search ..... 52/167.1, 167.5, 52/167.6, 167.4; 248/562, 566, 569

(56) References Cited

U.S. PATENT DOCUMENTS 951,028 A * 3/1910 Schar ..... 52/167.5
1,651,411 A * 12/1927 Porter ..... 52/167.6
2,014,643 A * 9/1935 Bakker ..... 384/49
6,052,955 A * 4/2000 Haider ..... 52/167.5
6,085,471 A * 7/2000 Axon ..... 52/167.4
6,116,784 A * 9/2000 Brotz ..... 384/99
6,324,795 B1 * 12/2001 Stiles et al. ..... 52/167.4
6,688,051 B2 * 2/2004 Tsai ..... 52/167.4
2002/0166296 A1 * 11/2002 Kim ..... 52/167.5
2004/0074162 A1 * 4/2004 Tsai ..... 52/167.5

* cited by examiner

*Primary Examiner*—Anita King
*Assistant Examiner*—A. Joseph Wujciak
(74) *Attorney, Agent, or Firm*—Pro-Techtor International Services

(57) ABSTRACT

An all-directional damping and earthquake-resisting unit is fixed to a lower part of an object, such as a column of a building, and a foundation for the object, so that functionally different members of the unit normally bear the weight of the object. When there is an earthquake, round balls included in the unit automatically roll and rotate on ball restoring means provided on two ball carriers while a piston assembly automatically moves in a buffer space, so that an instantaneous impact by the earthquake energy and any earthquake-induced displacement are absorbed by the unit. The balls and the piston assembly finally automatically return to their original positions in the unit, enabling the object and the foundation thereof to always locate at the same place without the risk of deviating from their centers.

31 Claims, 4 Drawing Sheets

ALL-DIRECTIONAL DAMPING AND EARTHQUAKE-RESISTING UNIT

FIELD OF THE INVENTION

The present invention relates to an all-directional damping and earthquake-resisting unit, which protects objects, such as the foundation and columns of a building, having the unit mounted thereto against displaced centers when an earthquake occurs.

BACKGROUND OF THE INVENTION

A first type of conventional vibration-isolating unit of ten used in constructions is shown in FIG. 1 and usually referred to as a laminated-rubber bearing unit. This type of vibration-isolating unit is produced by alternately disposing a plurality of metal sheets 13 and rubber laminae 14 between an upper bearing plate 11 and a lower bearing plate 15 to form a module, and subjecting the module to high pressure and curing, so that inner binding surfaces of the upper and the lower bearing plate 11, 15 are closely bound to a rubber outer wall 12 to form an integral body. The completed laminated-rubber bearing unit is in the form of a solid rubber cylinder providing a high bearing force. The upper and the lower bearing plate 11, 15 are pre-formed along their outer peripheries with a plurality of bolt mounting holes 16 for fixing the unit to and between the foundation and the column of the construction with bolts.

FIG. 2 shows a second type of conventional vibration-isolating unit that is usually referred to as a lead-cored laminated-rubber bearing unit, which is structurally and functionally similar to the laminated-rubber bearing unit of FIG. 1, except that it includes a lead cylinder 17 forming a core of the laminated-rubber bearing unit for the same to have upgraded vertical bearing capacity and deformation absorbing capacity.

The first and the second type of vibration-isolating units are functionally similar to each other. They all employ a laminated body formed from alternately disposed rubber laminae 14 and metal sheets 13 as a load-bearing elastomer. The upper and the lower bearing plate 11, 15 are separately located at two ends of a secant plane on a column of the construction. When the construction is subject to earthquake energy that results in vertical loading and displacements 19 of the construction, the laminated body formed from the rubber laminae 14 is changed into a barrel-like configuration or has a horizontal displacement and stretch 20, depending on its stress direction, to absorb the earthquake energy by taking advantage of an elasticity of rubber material.

When the above-mentioned vibration-isolating units are newly produced, they usually provide pretty good bonding capacity and restoring force to bear a high magnitude of displacement and stretch 20. However, these rubber-made vibration-isolating units are subjected to a shortened life due to many factors, including long-term ultra-high load and compression that results in structural changes and deformation of the rubber material, environmental climate, as well as temperature and humidity at the mounting location. When the vibration-isolating units have been used for a prolonged time, the bonding capacity of upper and the lower bearing plate 11, 15 to the laminated rubber body tends to reduce, and the units gradually lose their restoring force to bear the high magnitude of displacement and stretch 20. The cylindrical lead core 17 is initially provided for an upgraded capacity of absorbing deformation caused by vertical loading and displacement 19 and has a high plasticity as a preferred advantage thereof. However, the lead core 17 might have become seriously distorted and deformed under long-term compression by the ultra-high weight of the construction and different displacement angles resulted from earthquake origins from different directions. That is, the lead core 17 might have become extended, distorted, shortened, expanded, or even has a deformed shape 21 to separate from the laminated rubber body 14 and form gaps 18 between them, and could no longer be fitly and stably positioned in the laminated rubber body to produce its expected effect.

FIGS. 4 and 5 are perspective and side sectional views, respectively, of a third type of conventional vibration-isolating unit in the form of damper made of reinforced steel plates. This third type of vibration-isolating unit is produced by means of cutting thick steel plates into intermediate bearing plates 23 having a predetermined shape. The similarly shaped intermediate bearing plates 23 are equally spaced in the same direction, and are connected at upper and lower ends to even thicker upper and lower bearing plates 22, 24, respectively, by way of full fillet weld 25. The damper formed by densely welding so many similarly shaped steel plates of the same material to an extended plane would have a quality easily affected by temperature, time, operator's skill and workmanship, and changes in the stress of the steel material. It is therefore doubtful whether the damper of FIG. 4 having a stiff structural design is able to absorb vibrations from all directions. Moreover, this type of damper must be mounted along with large-scaled H-beam steel onto sidewalls of the construction in a predetermined pattern, and therefore requires complicate mounting procedures. In addition, it is uneasy to have good finishing at joints of the dampers with the sidewalls of the construction.

The above-described conventional vibration-isolating units for constructions are generally functionally reinforcing products. There are not commercially available all-directional earthquake-resisting products adapted to moderately dissipate or absorb the very strong instantaneous earthquake energy.

The above-described conventional vibration-isolating units all include a solid cylinder or a plurality of solid plates connected to upper and lower bearing plates to provide pretty good bearing capacity in terms of earthquake energy in a vertical direction. These solid cylinder or plates are, however, restricted by the upper and lower bearing plates to have inferior absorption efficiency in terms of horizontal displacement caused by earthquake energy in a horizontal direction.

Moreover, these conventional units are designed in an attempt to directly resist the earthquake energy with the hardness of their stiff structures. Such a design is obviously improper and not suitable for use below the foundation of a long-lived construction in view that no material has a hardness or strength high enough to directly resist the earthquake.

SUMMARY OF THE INVENTION

A primary object of the present invention is to provide an all-directional damping and earthquake-resisting unit to protect objects, such as the foundation and columns of a building, having the unit mounted thereto against displaced centers and accordingly damaged or even destructed structure when an earthquake occurs.

To achieve the above and other objects, the present invention is designed for fixing to a lower part of an object, such as a column of a building or a precision instrument, and a foundation for the object, and includes a plurality of functionally different members, including a top housing, a top load-bearing member, a bearing assembly, an inner-upper carrier, at least one rolling element, an inner-lower carrier, ball restoring means, a piston assembly, a buffer space, and a bottom housing, to normally bear the weight of the object. When there is an earthquake, the rolling element, such as round balls, mounted between the carriers automatically roll and rotate on the ball restoring means while the piston assembly automatically moves in the buffer space, so that an instantaneous impact by the earthquake energy from any direction and any earthquake-induced displacement are absorbed by the unit. The balls and the piston assembly finally automatically return to their original positions in the unit, enabling the object and the foundation thereof to always locate at the same place without the risk of deviating from their centers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
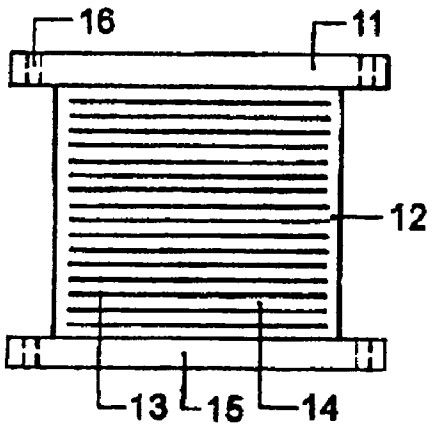
FIG.1 (PRIOR ART)
FIG. 1 is a front sectional view of a first conventional vibration-isolating unit with laminated rubber bearing body.
Figure 2:
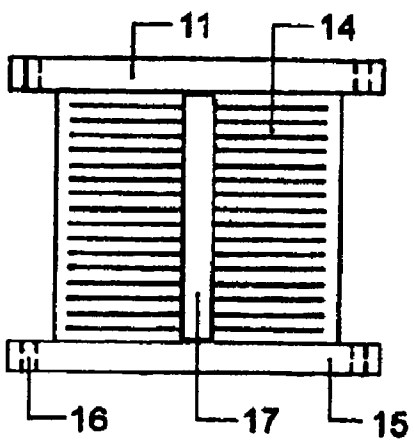
FIG.2 (PRIOR ART)
FIG. 2 is a front sectional view of a second conventional vibration isolating unit with laminated rubber bearing body and lead core.
Figure 3:
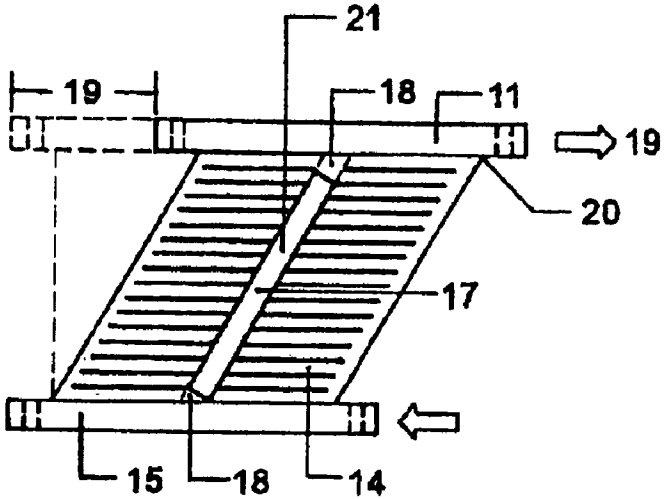
FIG.3 (PRIOR ART)
FIG. 3 is a front sectional view showing the vibration-isolating unit of FIG. 2 in a displaced state.
Figure 5:
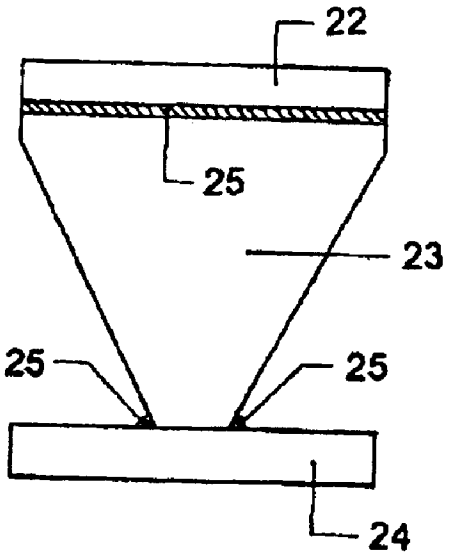
FIG.5 (PRIOR ART)
FIG. 5 is a side sectional view of FIG. 4.
Figure 4:
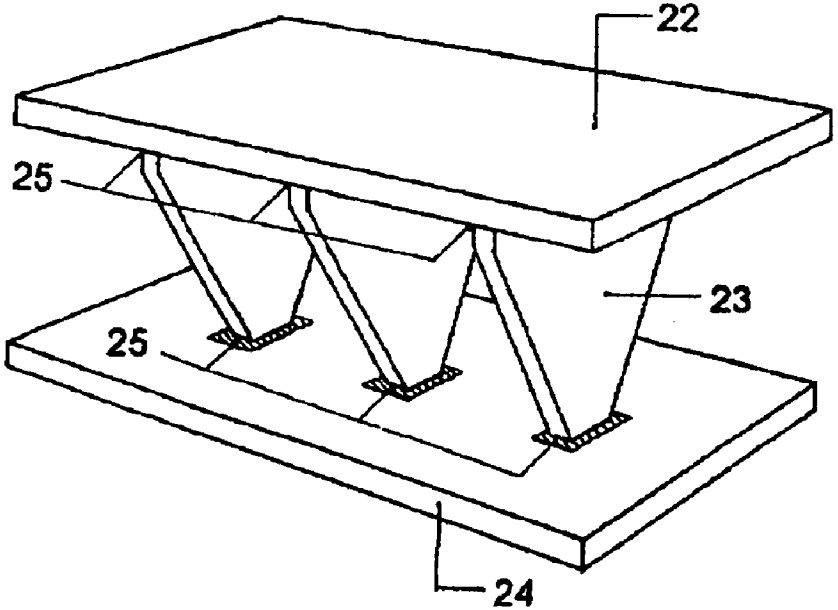
FIG.4 (PRIOR ART)
FIG. 4 is a perspective view of a third conventional vibration-isolating unit with damper made of reinforced steel plates.
Figure 6:
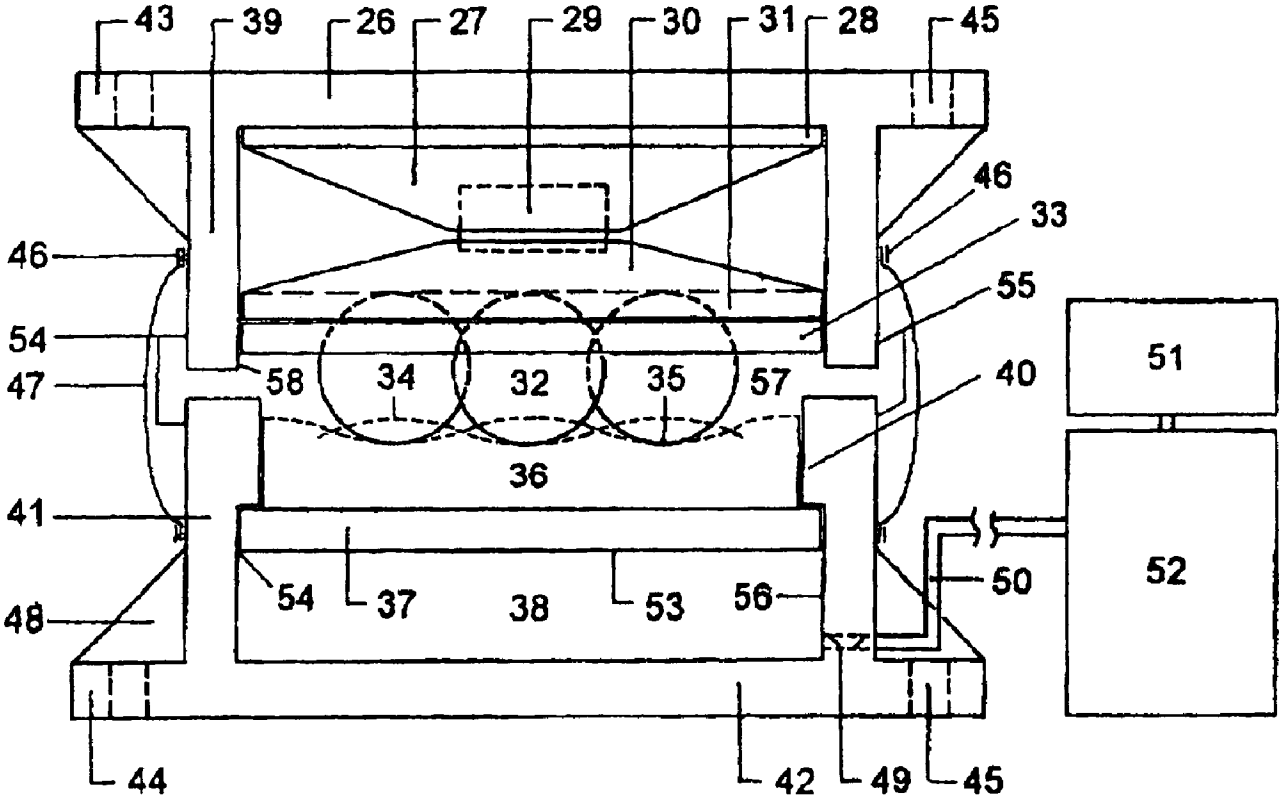
FIG. 6 is front sectional view of an all-directional damping and earthquake-resisting unit according to an embodiment of the present invention.
Figure 7:
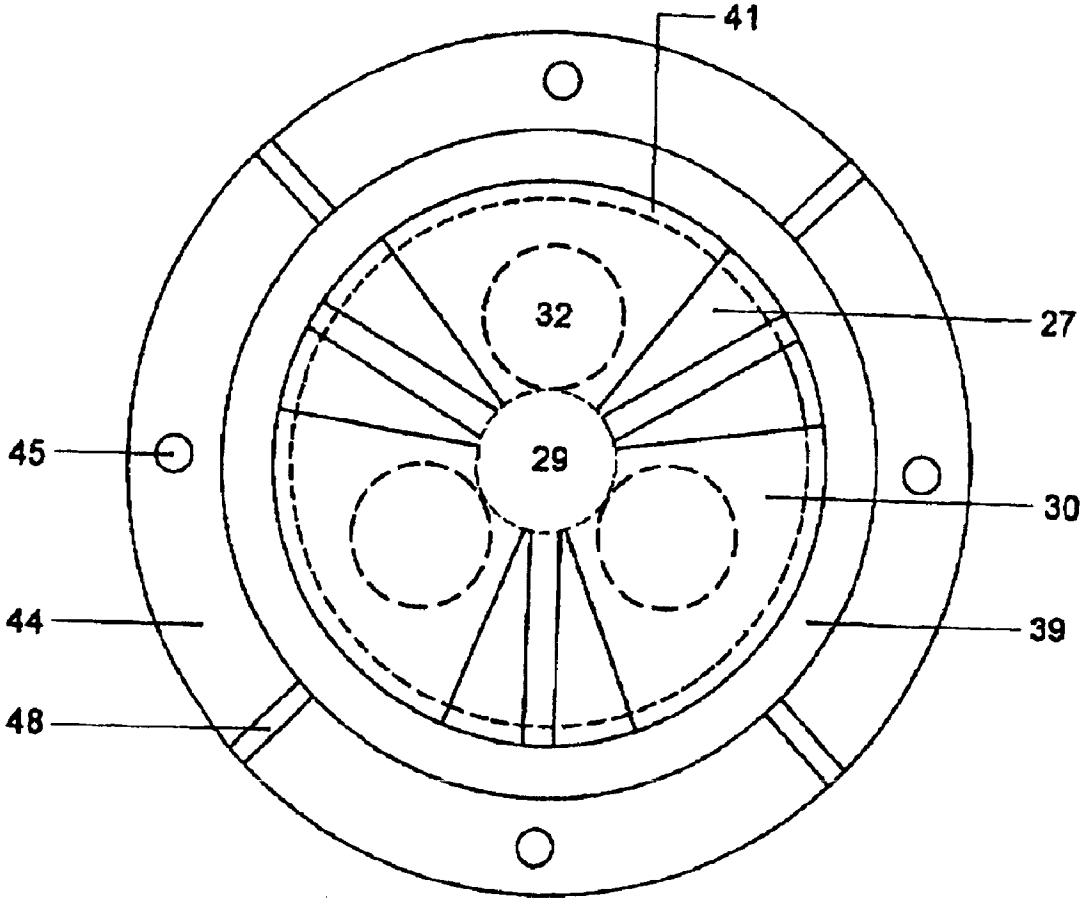
FIG. 7 is a top sectional view of the all-directional damping and earthquake-resisting unit of FIG. 6.

Please refer to FIGS. 6 and 7 that are front and top sectional views, respectively, of an all-directional damping and earthquake-resisting unit according to a preferred embodiment of the present invention. The unit of the present invention is to be mounted, for example, between a foundation and a plurality of columns below an object, such as a building or a precision instrument. To mount the unit, the columns must be separated from the foundation. When the building or the precision instrument is subject to an earthquake, the all-directional damping and earthquake-resisting unit of the present invention is adapted to effectively absorb instantaneous seismic energy impact from all directions, so as to protect the building or the precision instrument against serious damages.

As shown in FIGS. 6 and 7, the all-directional damping and earthquake-resisting unit of the present invention mainly includes from top to bottom a top housing 26, a top load-bearing member 28, a bearing assembly 29, an inner-upper carrier 30, at least one rolling element 32, an inner-lower carrier 36, ball restoring means 57, a piston assembly 37, a buffer space 38, and a bottom housing 42, and a control box 51 and a auxiliary box 52 located at an outer side of the bottom housing 42, a dust shield 47 located between and around the top and the bottom housing 26, 42, and a plurality of sensing elements provided at predetermined positions.

The top housing 26 is a circular steel member having a generally reversed U-shaped vertical section to include a top plate 43, an outer periphery of which is radially extended outward to form a flange portion with a plurality of bolt mounting holes 45, and an annular wall portion 39 downward extended from an underside of the top plate 43. A plurality of triangular reinforcing braces 48 are equally or unequally spaced between the flange portion of the top plate 43 and the annular wall portion 39 to connect the top plate 43 to the annular wall portion 39 and thereby gives the top plate 43 a reinforced strength. The top housing 26 encloses the top load-bearing member 28 and upper and peripheral portions of the inner-upper carrier 30.

The top load-bearing member 28 is a round steel dish-shaped member having a flat bottom and a downward tapered wall portion. That is, a wall portion of the top load-bearing member 28 extended between a top and the flat bottom is an inward and downward inclined surface. A plurality of energy-balancing boards 27 are provided at an underside of the top load-bearing member 28. The top load-bearing member 28 is provided at the flat bottom with an opening for receiving the bearing assembly 29 therein. Rolling elements (not shown) may be mounted at an upper side of the top load-bearing member 28, and outer peripheries of the top load-bearing member 28 and the inner-upper carrier 30 that are closely adjacent to inner wall surfaces of the top housing 26.

The bearing assembly 29 is a rolling element enabling smooth and free rotating motion, and set in and between openings provided at the flat bottom of the top load-bearing member 28 and a top of the inner-upper carrier 30. The bearing assembly 29 includes a round plate that has a plurality of balls positioned therein either in one row and in one layer or in more than one row and in more than one layer, and is positioned on a U-shaped, a reversed T-shaped, a curved, or a flat rail. The bearing assembly 29 uses centers of the top load-bearing member 28 and the inner-upper carrier 30 as a rotating shaft to rotate relative to the top load-bearing member 28 and the inner-upper carrier 30. In this manner, the top load-bearing member 28 and the inner-upper carrier 30 are allowed to turn in different directions under different applied force. Depending on actual needs, more than one bearing assembly 29 may be separately mounted between more than one set of top load-bearing member 28 and inner-upper carrier 30. It is also possible for the bearing assembly 29 to include multiple superposed layers, each of which includes one layer of balls. In addition to a location between the top load-bearing member 28 and the inner-upper carrier 30, the bearing assembly 29 may also be mounted between any two adjacent movable parts of the damping and earthquake-resisting unit of the present invention.

The inner-upper carrier 30 is a round steel dish-shaped member having a flat top and an upward tapered wall portion. That is, a wall portion of the inner-upper carrier 30 extended between the flat top and a bottom is an outward and downward inclined surface. A plurality of energy-balancing boards 27 are provided on an upper side of the wall portion of the inner-upper carrier 30, and a curved recess 31 is formed on the bottom of the inner-upper carrier 30. The inner-upper carrier 30 is provided at the flat top with an opening for receiving the bearing assembly 29 therein. Rolling elements (not shown) maybe mounted at an outer periphery of the inner-upper carrier 30 that is closely adjacent to inner wall surfaces of the top housing 26.

The rolling element 32 may be, for example, a ball having a high bearing capacity mounted between the inner-upper carrier 30 and the inner-lower carrier 36. The ball may be made of a metal or non-metal material and positioned between the inner-upper and the inner-lower carrier 30, 36. There may be only one ball, one single row of balls, one single layer of balls, or a plurality of balls in multiple rows and/or multiple layers. When there are multiple layers of balls, it is also possible to provide multiple sets of inner-upper and inner-lower carriers with each set having a layer of balls mounted thereto.

The inner-lower carrier 36 is in the form of a circular steel disc located below the inner-upper carrier 30 to support the rolling element 32 thereon. Rolling elements (not shown) may be mounted at interfaces between the inner-lower carrier 36 and the piston assembly 37, and an outer periphery of the inner-lower carrier 36 and an inner wall surface of an inner flange 40 of the bottom housing 42.

The ball restoring means 57 include at least one wavy surface having a plurality of successively arranged and staggered convexes 34 and concaves 35 formed thereon. The wavy surface is provided on at least one of the two adjacent surfaces on the inner-upper and the inner-lower carrier 30, 36. The other one of the two adjacent surfaces is formed into a curved recess 31. In the illustrated embodiment, the wavy surface is provided on a top of the inner-lower carrier 36 and the curved recess 31 on a bottom of the inner-upper carrier 30. With these arrangements, the rolling element 32 is always located between the curved recess 31 and one of the concaves 35. Alternatively, two wavy surfaces both having a plurality of successively arranged and staggered convexes 34 and concaves 35 formed thereon may be correspondingly provided on the two adjacent surfaced on the inner-upper and the inner-lower carrier 30, 36, so that the rolling element 32 is always located between two concaves 35 on the two wavy surfaces. The ball restoring means 57 further includes a holed disc 33 provided on one of the two adjacent surfaces on the inner-upper and the inner-lower carrier 30, 36 and having a plurality of ball-engaging holes in a number corresponding to that of the balls included in the rolling element 32, so that the balls 32 are always partially located in the ball-engaging holes. The above-mentioned bearing assembly 29 and rolling element 32 (including the ball restoring means 57) may be exchanged in their mounting positions.

The piston assembly 37 is a round-sectioned steel member mounted below the inner-lower carrier 36 and may be in the form of a flat plate, a ball or a cylinder. The piston assembly 37 has an outer wall surface in close contact with a lower inner wall surface of an annular wall portion 41 of the bottom housing 42 via some guiding means, such as a guide rail or a guide way provided on one of the above-mentioned outer and inner surfaces. As can be seen from FIG. 6, an upper inner wall surface of the annular wall portion 41 of the bottom housing 42 radially inward projected to form an inner flange 40, so that the lower inner wall surface of the annular wall portion 41 correspondingly forms a guide way 56 for the piston assembly 37. The piston assembly 37 may be reciprocatingly moved using various types of means, such as, for example, screw rods, bearings, slide rails, linear motions, gears, or levers, or a combination of any two or more of these means. It is also possible to provide multiple layers of combined piston assembly 37 and bottom housing 42 for mounting between two adjacent movable parts or below the inner-lower carrier 36 of the damping and earthquake-resisting unit of the present invention.

The bottom housing 42 is a circular steel member having a generally U-shaped vertical section to include a bottom plate 44, an outer periphery of which is radially extended outward to form a flange portion with a plurality of bolt mounting holes 45, and an annular wall portion 41 upward extended from an upper side of the bottom plate 44. A plurality of triangular reinforcing braces 48 are equally or unequally spaced between the flange portion of the bottom plate 44 and the annular wall portion 41 to connect the bottom plate 44 to the annular wall portion 41 and thereby gives the bottom plate 44 a reinforced strength. The bottom housing 42 encloses the inner-lower carrier 36 and lower and peripheral portions of the piston assembly 37. Both the annular wall portion 41 of the bottom housing 42 and the annular wall portion 39 of the top housing 26 are provided between respective inner and outer wall surfaces with a travel distance limiter (not shown), which may be in the form of a movable limiting link, a guide-rail type side stopper, a fixed type side stopper, or an electromagnetically controlled pressure-type side stopper. The travel distance limiter is an element having a preset space interval being fixedly mounted on any one of the bottom housing 42 and the top housing 26. In the event any one of the two housings is moved due to displacement, the travel distance limiter may timely provide a braking resistance of a preset pressure to slow down, restrict, or stop the movement of the bottom or top housing, so that the bottom and the top housings would not displace at an overly large rate.

The buffer space 38 is formed between the bottom housing 42 and the piston assembly 37 to provide a buffer effect and to bear high magnitude of changes in pressure. The buffer space 38 is filled with a high-pressure bearing substance, which may be a substance in gas, liquid or gel state, an oil pressure, or any other substance that may effectively produce high pressure and high bearing capacity, enabling the piston assembly 37 to move in a reciprocating motion and bearing a load via changes of pressure in the buffer space 38. The high bearing-capacity substance may be rubber, spring, polymer, metal or non-metal material, and may be in the form of one or more modules or solid bodies, or in the form of a bag, a line, a sheet, a disc, a strip, a bar, a mass of fibers, or a zigzag shape that uses inherent elastic tension to support a load. The high pressure bearing substance may also be a soft, gelled substance showing pliable, elastic, viscous, inert properties. The buffer space 38 is provided at one side with a valve 49 and pipelines 50 that are led to the auxiliary box 52.

The auxiliary box 52 is electrically connected to the control box 51 for supplying and storing the high pressure bearing substance needed by the buffer space 38. The auxiliary box 52 includes various kinds of necessary control valves, attenuator valve, power cylinder, compressor, dryer, pumps, etc. to enable automatic regulating and balancing of an internal pressure of the buffer space 38.

A plurality of different sensing elements, including pressure sensors 53, height sensors 54, displacement sensors 55, and vector sensors 58, that together form a mode signal control mechanism, may be provided between different movable parts of the damping and earthquake-resisting unit of the present invention for automatically detecting and sensing height, displacement, pressure, and vector of the movable parts and timely and dynamically regulating the unit.

The control box 51 is a microcomputer-controlled system for automatically detecting and operating signals of changes detected by the above-mentioned pressure sensors 53, height sensors 54, displacement sensors 55, and vector sensors 58.

The dust shield 47 is fixed around an outer periphery between the top and the bottom housing 26, 42 by means of, for example, two sets of hoops 46 held to outer wall surfaces of the annular wall portions 39 and 41 of the top and the bottom housing 26 and 42, respectively, to shield a gap between the top and the bottom housing 26, 42. The dust shield 47 may be made of a metal, a non-metal, a rubber, or a plastic material in the form of a plate, a sheet, or a film to provide an appropriate deformation capacity.

How the present invention functions to absorb earthquake energy from a horizontal direction will now be explained as below.

When a foundation is attacked by a preliminary earthquake energy, the bottom housing 42 that is connected to the foundation would generate reciprocating displacement in a certain direction at the same time while the top housing 26 remains steady under the weight of a building above it. At this stage, the curved recess 31 of the inner-upper carrier 30 is in smooth and close contact with the round bodies of the balls constituting the rolling elements 32 to absorb a reciprocating impact from the horizontal earthquake energy. More specifically, the balls 32 are subject to the force of earthquake energy only at a lower end thereof and would rotate at the same place, that is, in the concaves 35 of the ball restoring means 57. This is the first stage of absorbing earthquake energy by the damping and earthquake-resisting unit of the present invention.

When the earthquake energy continues over a period of time, and the bottom housing 42 has possibly reciprocatingly displaced by a certain distance, the balls 32, which are inert due to their smooth round outer surface, would now simply move upward to contact with a slope of the concaves 35 of the ball restoring means 57. Meanwhile, since the high weight of the building stably born by the top housing 26 is evenly distributed over the balls 32 via the inner-upper carrier 30, and the bearing assembly 29 and the inner-upper carrier 30 are allowed to smoothly move relative to each other to produce a stress-relieving effect, the balls 32 are allowed to moderately reciprocatingly roll and rotate in the concaves 35 between the slope and a bottom thereof to absorb the earthquake energy instead of refusing the same with any stiff structure. This is the second stage of absorbing earthquake energy by the damping and earthquake-resisting unit of the present invention.

When the earthquake energy continues further over a period of time, and the earthquake energy has strength and direction that keep unchanged or the earthquake energy becomes intensified, the balls 32 would then possibly be moved from the bottom of the concaves 35 to a top of the convexes 34. However, the rotation of the bearing assembly 29 relative to the inner-upper carrier 30 would change the stress and the moving direction of the balls 32 for the same to quickly roll downward into the original or adjacent concaves 35 and thereby timely relieve any powerful inertial impetus of the balls 32. This is the third stage of absorbing earthquake energy by the damping and earthquake-resisting unit of the present invention.

In the event the earthquake-induced displacement pauses or changes to a different direction in the above-mentioned second stage, the balls 32 immediately automatically roll downward to the bottom of the concaves 35 as a result of the weight of the building. Meanwhile, as an indirect control by the bearing assembly 29 located at the center of the inner-upper carrier 30, the inner-upper carrier 30 would automatically change the moving direction of the balls 32 for the same to return to their original positions when there is any change, pause, reduction of the strength of the earthquake energy or the direction of the displacement caused by the earthquake energy. No matter what the direction of the earthquake energy is, or how long the earthquake energy continues in the same direction, or how quickly the earthquake energy results in an instantaneous impact, the balls 32 always moderately absorb the impact and roll in an inertial manner instead of resisting the earthquake energy through an increased frictional force or an inherent structural strength. The balls 32 would finally return to their original positions and prevent the columns of the building from deviation of center. Even if in the third stage in which the earthquake energy seriously continues in the same direction, the balls 32 would only roll by different angular degrees and exchange their positions in different concaves 35. The whole damping and earthquake-resisting unit and the center of the column having the unit mounted thereto would still locate at the same original position without any change.

How the present invention functions to absorb earthquake energy from a vertical direction will now be explained as below.

When the damping and earthquake-resisting unit of the present invention is duly mounted, the buffer space 38 and the auxiliary box 52 are also set to predetermined internal pressure values. When the building is impacted by instantaneous earthquake energy from a vertical direction, the buffer space 38 is subject to a compression caused by acceleration of gravity. When the pressure in the buffer space 38 is overly large, it would automatically release via the control valve 49 and one of the pipelines 50 into the auxiliary box 52 and thereby absorbs the impacting force and provides the buffer effect. Meanwhile, the auxiliary box 52 may supply pressure via another pipeline 50 to the buffer space 38 for the latter to maintain the preset pressure value. In the event the newly supplied pressure is lower than the preset pressure value or the piston assembly 37 is moved to a different height, the pressure sensor 53 and the height sensor 54 would automatically detect the change and send a mode signal to the control box 51, so that the control box 51 may timely regulate the auxiliary box 52 to restore the piston assembly 37 to a desired height in the bottom housing 42.

In another embodiment of the present invention, the all-directional damping and earthquake-resisting unit includes at least one inner-upper carrier 30, at least one inner-lower carrier 36 separately located below the at least one inner-upper carrier 30, at least one round ball 32 located between each set of the inner-upper and inner-lower carriers 30, 36, and ball restoring means 57 for holding the balls 32 in given places between the inner-upper and the inner-lower carrier 30, 36. All the above-mentioned members, including the carriers 30, 36, the balls 32, and the ball-restoring means 57, are structurally similar to the same members included in the first preferred embodiment. The dust shield 47 for this embodiment is also similar to that of the preferred embodiment, except that it is mounted to an outer periphery between the inner-upper and the inner-lower carrier 30, 36. The inner-upper carrier 30 and the inner-lower carrier 36 are respectively fixed to a lower part of an object, such as a column of a building, and a foundation for the object, so that the carriers 30, 36 are normally subject to the weight of the object. When there is an earthquake, the round balls 32 roll and rotate on the ball-restoring means 57 to absorb the instantaneous impact by the earthquake energy and the earthquake-induced displacement, and finally automatically return to their original positions, enabling the object and the foundation thereof to always locate at the same place without the risk of deviating from their centers.

In a further embodiment of the present invention, the all-directional damping and earthquake-resisting unit includes at least one inner-upper carrier 30, a top housing 26 enclosing a top and a peripheral wall of the inner-upper carrier 30, at least one inner-lower carrier 36 separately located below the at least one inner-upper carrier 30, at least one round ball 32 located between each set of the inner-upper and inner-lower carriers 30, 36, and ball restoring means 57 for holding the balls 32 in given places between the inner-upper and the inner-lower carrier 30, 36. All the above-mentioned members, including the carriers 30, 36, the top housing 26, the balls 32, and the ball-restoring means 57, are structurally similar to the like members included in the first preferred embodiment. The dust shield 47 for this embodiment is also similar to that of the preferred embodiment, except that it is mounted to an outer periphery between the top housing 26 and the inner-lower carrier 36. The top housing 26 and the inner-lower carrier 36 are respectively fixed to a lower part of an object, such as a column of a building, and a foundation for the object, so that the top housing 26 and the inner-lower carrier 36 are normally subject to the weight of the object. When there is an earthquake, the round balls 32 roll and rotate on the ball-restoring means 57 to absorb the instantaneous impact by the earthquake energy and the earthquake-induced displacement, and finally automatically return to their original positions, enabling the object and the foundation thereof to always locate at the same place without the risk of deviating from their centers.

In a still further embodiment of the present invention, the all-directional damping and earthquake-resisting unit includes at least one inner-upper carrier 30, a top load-bearing member 28 located above the inner-upper carrier 30, a bearing assembly 29 mounted between the inner-upper carrier 30 and the top load-bearing member 28, a top housing 26 enclosing a top and a peripheral wall of the top load-bearing member 28 and the inner-upper carrier 30, at least one inner-lower carrier 36 located below the at least one inner-upper carrier 30, at least one round ball 32 located between each set of the inner-upper and inner-lower carriers 30, 36, and ball restoring means 57 for holding the balls 32 in given places between the inner-upper and the inner-lower carrier 30, 36. All the above-mentioned members, including the carriers 30, 36, the top housing 26, the top load-bearing member 28, the bearing assembly 29, the balls 32, and the ball-restoring means 57, are structurally similar to the like members included in the first preferred embodiment. The dust shield 47 for this embodiment is also similar to that of the preferred embodiment, except that it is mounted to an outer periphery between the top housing 26 and the inner-lower carrier 36. The top housing 26 and the inner-lower carrier 36 are respectively fixed to a lower part of an object, such as a column of a building, and a foundation for the object, so that the top housing 26 and the inner-lower carrier 36 are normally subject to the weight of the object. When there is an earthquake, the round balls 32 roll and rotate on the ball-restoring means 57 to absorb the instantaneous impact by the earthquake energy and the earthquake-induced displacement, and finally automatically return to their original positions, enabling the object and the foundation thereof to always locate at the same place without the risk of deviating from their centers.

In a still further embodiment of the present invention, the all-directional damping and earthquake-resisting unit an inner-lower carrier 36, a piston assembly 37 mounted below the inner-lower carrier 36, a bottom housing 42 enclosing a bottom and a peripheral wall of the inner-lower carrier 36 and the piston assembly 37, and a buffer space 38 formed in the bottom housing 42 below the piston assembly 37 to provide a buffer effect and bear a high magnitude of changes in pressure. All the above-mentioned members, including the inner-lower carrier 36, the bottom housing 42, and the piston assembly 37, are structurally similar to the like members included in the first preferred embodiment, except that the inner-lower carrier 36 is provided at a top with a top plate. The inner-lower carrier 36 and the bottom housing 42 are respectively fixed to a lower part of an object, such as a column of a building, and a foundation for the object, so that the bottom housing 42 and the inner-lower carrier 36 are normally subject to the weight of the object. When there is an earthquake, and the object is subject to an instantaneous impact by the earthquake energy from a vertical direction, the piston assembly 37 may function to absorb the instantaneous impact from the vertical direction and automatically return to an original height in the buffer space 38 through control and regulation of the buffer space 38 and other related members.

In conclusion, the present invention is particularly developed according to varied properties of earthquake, and includes a plurality of simple load-bearing members that bear the weight of the construction to which the present invention is mounted and therefore become inert in motion to moderately relieve the instantaneous impact by the earthquake energy from any direction and then automatically return to their original positions after occurrence of any displacement, ensuring the construction to always maintain in a safe state.

What is claimed is:

1. An all-directional damping and earthquake-resisting unit, comprising:

at least one inner-upper carrier;

at least one inner-lower carrier located below said at least one, inner-upper carrier, at least one round ball located between said at least one inner-upper and inner-lower carriers and being capable of bearing a high weight; and ball restoring means for holding said at least one round ball in a given place between said at least one inner-upper and inner-lower carriers;

wherein said ball restoring means include a wavy surface having a plurality of successively arranged and staggered convexes and concaves formed thereon, said wavy surface being provided on one of two adjacent surfaces on said at least one inner-upper and inner-lower carriers; and a curved recess formed on the other one of said two adjacent surfaces on said at least one inner-upper and inner-lower carriers, such that said at least one round ball is always retained between said curved recess and said concaves of said wavy surface.

2. An all-directional damping and earthquake-resisting unit, comprising:

at least one inner-upper carrier;

at least one inner-lower carrier located below said at least one, inner-upper carrier, at least one round ball located between said at least one inner-upper and inner-lower carriers and being capable of bearing a high weight; and ball restoring means for holding said at least one round ball in a given place between said at least one inner-upper and inner-lower carriers;

wherein said ball restoring means include two wavy surfaces having a plurality of successively arranged and staggered convexes and concaves formed thereon, said wavy surfaces being provided on two adjacent surfaces on said at least one inner-upper and inner-lower carriers, such that said at least one round ball is always retained between said concave of said two wavy surfaces.

3. The all-directional damping and earthquake-resisting unit as claimed in claim 1, wherein said ball restoring means further include a holed disc that is provided on one of said two adjacent surfaces on said inner-upper and inner-lower carriers and has a plurality of ball-engaging holes in a number corresponding to that of said at least one ball, such that said at least one ball is always partially located in said ball-engaging holes.

4. An all-directional damping and earthquake-resisting unit, comprising:

at least one inner-upper carrier;

at least one top load-bearing member located above said inner-upper carrier;

at least one bearing assembly mounted between said inner-upper carrier and said top load-bearing member, and said bearing assembly using centers of said inner-upper carrier and said top load-bearing member as a rotating shaft to rotate relative to said top load-bearing member and said inner-upper carrier;

a top housing having a generally reversed U-shaped vertical section and including a top plate and an annular wall portion downward extended from an underside of said top plate; and said top housing enclosing said top load-bearing member and upper and peripheral portions of said inner-upper carrier;

at least one inner-lower carrier located below said inner-upper carrier;

at least one round ball disposed between said inner-upper and inner-lower carriers and capable of bearing a high weight; and ball restoring means for holding said at least one round ball in a given place between said inner-upper and inner-lower carriers.

5. The all-directional damping and earthquake-resisting unit as claimed in claim 4, wherein said ball restoring means include a wavy surface having a plurality of successively arranged and staggered convexes and concaves formed thereon, said wavy surface being provided on one of two adjacent surfaces on said at least one inner-upper and inner-lower carriers; and a curved recess formed on the other one of said two adjacent surfaces on said at least one inner-upper and inner-lower carriers, such that said at least one round ball is always retained between said curved recess and said concaves of said wavy surface.

6. The all-directional damping arid earthquake-resisting unit as claimed in claim 4, wherein said ball restoring means include two wavy surfaces having a plurality of successively arranged and staggered convexes and concaves formed thereon, said wavy surfaces being provided on two adjacent surfaces on said at least one inner-upper and inner-lower carriers, such that said at least one round ball is always retained between said concaves of said two wavy surfaces.

7. The all-directional damping and earthquake-resisting unit as claimed in clam 5, wherein said ball restoring means further include a holed disc that is provided on one of said two adjacent surfaces on said inner-upper and inner-lower carriers and has a plurality of ball-engaging holes in a number corresponding to that of said at least one ball, such that said at least one ball is always partially located in said ball-engaging holes.

8. The all-directional damping and earthquake-resisting unit as claimed in claim 4, wherein said at least one round balls is located between said inner-upper and inner-lower carriers either in one row and in one layer or in multiple rows and in multiple layers.

9. The all-directional damping and earthquake-resisting unit as claimed in claim 4, wherein said top load-bearing member, said at least one bearing assembly, and said at least one inner-upper carrier are alternately disposed in multiple layers.

10. The all-directional damping and earthquake-resisting unit as claimed in claim 4, wherein said bearing assembly is a rolling element including a round plate that has a plurality of balls positioned therein either in one row and in one layer or in multiple rows and multiple layers, and is positioned on a U-shaped, a reversed T-shaped, a curved, or a flat rail.

11. The all-directional damping and earthquake-resisting unit as claimed in claim 4, wherein said bearing assembly and said round ball, including said ball restoring means, are exchangeable in mounting positions.

12. The all-directional damping and earthquake-resisting unit as claimed in claim 4, wherein rolling elements are mounted between an inner wall surface of said top housing and a top of said top load-bearing member as well as outer peripheral surfaces of said top load-bearing member and said inner-upper carrier.

13. The all-directional damping and earthquake-resisting unit as claimed in claim 4, wherein further comprising a dust shield mounted around a space between said inner-upper and inner-lower carriers.

14. The all-directional damping and earthquake-resisting unit as claimed in claim 13, wherein said dust shield is mounted around said inner-upper and inner-lower carriers to cover said space therebetween by holding hoops to outer wall surfaces of said inner-upper and inner-lower carriers.

15. An all-directional damping and earthquake-resisting unit, comprising:

at least one inner-upper carrier;

at least one top load-bearing member located above said inner-upper carrier;

at least one bearing assembly mounted between said inner-upper carrier and said top load-bearing member, and said bearing assembly using centers of said inner-upper carrier and said top load-bearing member as a rotating shaft to rotate relative to said top load-bearing member and said inner-upper carrier;

a top housing having a generally reversed U-shaped vertical section and including a top plate and an annular wall portion downward extended from an underside of said top plate, and said top housing enclosing said top load-bearing member and upper and peripheral portions of said inner-upper carrier;

at least one inner-lower carrier located below said inner-upper carrier;

at least one round ball disposed between said inner-upper and inner-lower carriers and capable of bearing a high weight;

ball restoring means for holding said at least one round ball in a given place between said inner-upper and inner-lower carriers;

at least one piston assembly mounted below said inner-lower carrier;

at least one bottom housing having a generally U-shaped vertical section, and including a bottom plate and an annular wall portion upward extended from an upper side of said bottom plate, and said bottom housing enclosing said inner-lower carrier and lower and peripheral portions of said piston assembly; and at least one buffer space formed between said bottom housing and said piston assembly and filled with a high-pressure bearing substance to provide a buffer effect and bear high magnitude of changes in pressure by filling.

16. The all-directional damping and earthquake-resisting unit as claimed in claim 15, wherein said ball restoring means include a wavy surface having a plurality of successively arranged and staggered convexes and concaves formed thereon, said wavy surface being provided on one of two adjacent surfaces on said at least one inner-upper and inner-lower carriers; and a curved recess formed on the other one of said two adjacent surfaces on said at least one inner-upper and inner-lower carriers, such that said at least one round ball is always retained between said curved recess and said concaves of said wavy surface.

17. The all-directional damping and earthquake-resisting unit as claimed in claim 15, wherein said ball restoring means include two wavy surfaces having a plurality of successively arranged and staggered convexes and concaves formed thereon, said wavy surfaces being provided on two adjacent surfaces on said at least one inner-upper and inner-lower carriers, such that said at least one round ball is always retained between said concaves of said two wavy surfaces.

18. The all-directional damping and earthquake-resisting unit as claimed in claim 16, wherein said ball restoring means further include a holed disc that is provided on one of said two adjacent surfaces on said inner-upper and inner-lower carriers and has a plurality of ball-engaging holes in a number corresponding to that of said at least one ball, such that said at least one ball is always partially located in said ball-engaging holes.

19. The all-directional damping and earthquake-resisting unit as claimed in claim 15, wherein said at least one round balls is located between said inner-upper and inner-lower carriers either in one row and in one layer or in multiple rows and in multiple layers.

20. The all-directional damping and earthquake-resisting unit as claimed in claim 15, wherein said top load-bearing member, said at least one bearing assembly, and said at least one inner-upper carrier are alternately disposed in multiple layers.

21. The all-directional damping and earthquake-resisting unit as claimed in claim 15, wherein said bearing assembly is a rolling element including a round plate that has a plurality of balls positioned therein either in one row and in one layer or in multiple rows and multiple layers, and is positioned on a U-shaped, a reversed T-shaped, a curved, or a flat rail.

22. The all-directional damping and earthquake-resisting unit as claimed in claim 15, wherein said bearing assembly and said round ball, including said ball restoring means, are exchangeable in mounting positions.

23. The all-directional damping and earthquake-resisting unit as claimed in claim 15, wherein rolling elements are mounted between an inner wall surface of said top housing and a top of said top load-bearing member as well as outer peripheral surfaces of said top load bearing member and said inner-upper carrier.

24. The all-directional damping and earthquake-resisting unit as claimed in claim 15, further comprising a dust shield mounted around a space between said inner-upper and inner-lower carriers.

25. The all-directional damping and earthquake-resisting unit as claimed in claim 24, wherein said dust shield is mounted around said inner-upper and inner-lower carriers to cover said space therebetween by holding boops to outer wall surfaces of said inner-upper and inner-lower carriers.

26. The all-directional damping and earthquake-resisting unit as claimed in claim 15, wherein said piston assembly may be in the form of a flat plate, a ball, or a cylinder.

27. The all-directional damping and earthquake-resisting unit as claimed in clam 15, wherein said high-pressure bearing substance filled in said buffer space may be a substance in gas, liquid or gel state, or an oil pressure.

28. The all-directional damping and earthquake-resisting unit as claimed in claim 15, wherein said high-pressure bearing substance filled in said buffer space may be rubber, spring, polymer, metal or non-metal material, and may be in the form of one or more modules or solid bodies that uses inherent elastic tension to support a load.

29. The all-directional damping and earthquake-resisting unit as claimed in claim 15, wherein said buffer space is provided at one side with a valve and pipelines that are led to an auxiliary box.

30. The all-directional damping and earthquake-resisting unit as claimed in claim 29, wherein said auxiliary box includes various kinds of necessary control valves, attenuator valve, power cylinder, compressor, dryer, pumps, etc. to enable automatic regulating and balancing of an internal pressure of the buffer space.

31. The all-directional damping and earthquake-resisting unit as claimed in claim 15, further comprising a control box that is a microcomputer-controlled system for automatically detecting and operating signals of changes detected by pressure sensors, height sensors, displacement sensors, and vector sensors mounted on said damping and earthquake-resisting unit at predetermined positions.

* * * * *